US006077148A

United States Patent [19]

Klein et al.

[11] Patent Number: 6,077,148

[45] Date of Patent: Jun. 20, 2000

[54] SPHERICAL LAPPING METHOD

[75] Inventors: Kathy Klein, Columbia City; Randall Shepherd, Warsaw; Doug Harris, Syracuse, all of Ind.

[73] Assignee: DePuy Orthopaedics, Inc., Warsaw, Ind.

[21] Appl. No.: 09/258,599

[22] Filed: Feb. 26, 1999

[51] Int. Cl.[7] ..... B24B 9/00; B24B 1/00; B24B 5/02

[52] U.S. Cl. ..... 451/11; 451/5; 451/65

[58] Field of Search ..... 451/5, 50, 65, 451/66, 180

[56] References Cited

U.S. PATENT DOCUMENTS

| | | | |
|---|---|---|---|
| 2,982,057 | 5/1961 | Stanhope | 451/50 |
| 3,050,909 | 5/1962 | Rawstron | 451/50 X |
| 5,241,792 | 9/1993 | Naka et al. | 451/307 X |
| 5,299,394 | 4/1994 | Surdacki | 451/50 |

FOREIGN PATENT DOCUMENTS

| | | | |
|---|---|---|---|
| 401005769 | 1/1989 | Japan | 451/50 |
| 403032562 | 2/1991 | Japan | 451/50 |
| 403121759 | 5/1991 | Japan | 451/50 |
| 403196963 | 8/1991 | Japan | 451/50 |
| 404250964 | 9/1992 | Japan | 451/50 |

*Primary Examiner*—David A. Scherbel
*Assistant Examiner*—Anthony Ojini

[57] ABSTRACT

A method of lapping a spherical head comprises the steps of: rotatably mounting a plurality of lapping fixtures having generally semi-spherical cavities, securing polishing liners in the generally semi-spherical cavities, applying a wetting agent and diamond suspensions, varying from a relatively coarse grit to a relatively fine grit, to the polishing liners disposed in the lapping fixtures, manipulating the robotic arm to sequentially bring a spherical head into engagement with the polishing liners disposed in the lapping fixtures while the lapping fixtures are spinning about their respective rotational axes and to vary the angle between the longitudinal axis of the spherical head and the rotational axes of the lapping fixtures and rinsing the diamond suspensions from the spherical head.

91 Claims, 4 Drawing Sheets

130

SPHERICAL LAPPING METHOD

BACKGROUND AND SUMMARY OF THE INVENTION

The present invention relates generally to prosthetic joints and, particularly to a spherical head used in such applications. More particularly, the present invention relates to a method for producing a spherical head having a very smooth surface for prosthetic applications.

The recent advances in the use of implantable prosthetic joints to replace natural joints in humans have produced significant improvements. Many designs for such prosthetic implants, such as hip prosthesis, require a spherical head having a highly polished surface to reduce friction and increase the life of the joint.

It is known to machine parts from bar stock on a ball grinder to produce parts that are spherical, but have a relatively rough surface. The parts are then buffed on a buffer to achieve a polished surface. A problem with the buffing process, however, is that surface irregularities, such as grinding and buffing lines, remain on the finished part.

According to the present invention, a method of lapping a spherical head is provided which reduces surface irregularities on the finished part. The method comprises the steps of rotatably mounting a plurality of lapping fixtures having generally semi-spherical cavities, positioning polishing cloths or liners in the generally semi-spherical cavities, sequentially bringing the spherical head into engagement with the spinning lapping fixtures and varying the angle between the longitudinal axis of the spherical head and the rotational axes of the lapping fixtures between forward and reverse rotations of the spherical head about its longitudinal axis.

In accordance with preferred embodiments, the subject method further includes the step of applying a wetting agent and diamond suspensions varying from a relatively coarse grit to a relatively fine grit to the lapping fixtures. Also in accordance with further preferred embodiments, the subject method includes the step of rinsing the lapping compounds from the spherical head.

In the illustrated embodiments, the subject method further includes the step of positioning a generally daisy-shaped polishing cloth having adhesive backing in each of the semi-spherical cavities. The adhesive backing ensures good engagement between the mating surfaces of the polishing cloths and the respective semi-spherical cavities.

According to the present invention, each lapping fixture comprises a central core having a top end defining a generally semi-spherical cavity and an outer sleeve having an opening adapted for receiving the central core. According to still further preferred embodiments, the subject method further includes the steps of positioning the polishing liners in the respective semi-spherical cavities with the peripheral portions thereof extending over the top ends of the lapping fixtures and mounting the outer sleeves over the central cores to clamp the peripheral portions of the polishing liners in place.

In illustrated embodiments, the lapping fixture includes a plurality of modular inserts for lapping a corresponding plurality of heads having different diameters. Each modular insert has the same predetermined outside diameter to securely fit the opening in the central core of the lapping fixture, but a different diameter semi-spherical cavity.

Additional features and advantages of the present invention will become apparent to those skilled in the art upon consideration of the following detailed description of preferred embodiments exemplifying the best mode of carrying out the inventions presently perceived.

BRIEF DESCRIPTION OF THE DRAWINGS

The detailed description particularly refers to the accompanying figures in which.

DETAILED DESCRIPTION OF THE DRAWINGS

Figure 1:
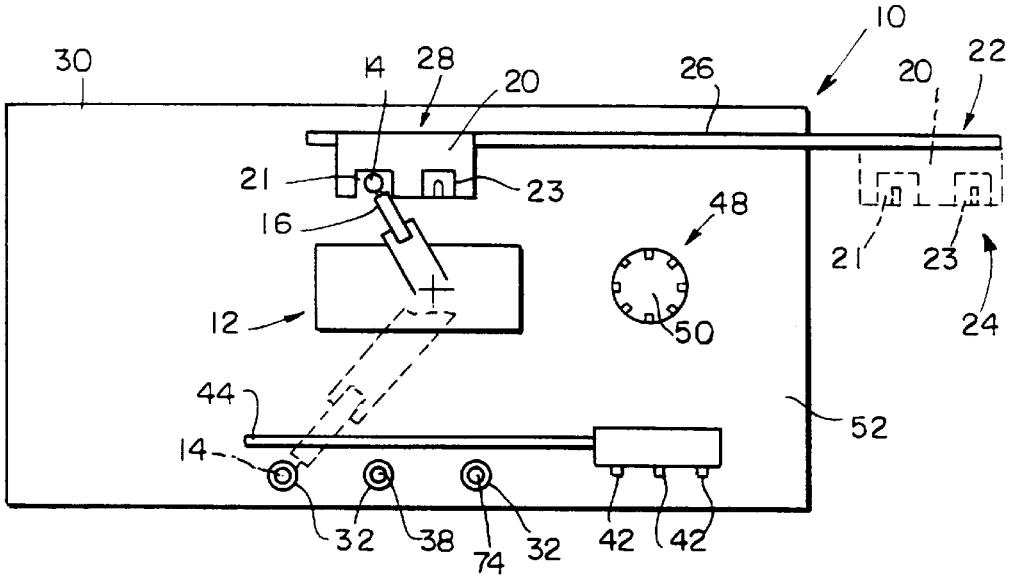
FIG. 1 is a diagrammatic view of a robotic spherical lapping apparatus and a method for lapping spherical modular heads in accordance with the present invention.

Turning now to the drawings, FIG. 1 is a diagrammatic view of a robotic spherical lapping apparatus 10 and a method for lapping spherical heads in accordance with the present invention. A robot 12 is used for lapping a modular spherical head 14. The spherical head 14 is mounted on an arbor 16 and placed in a loading fixture 20 at a load/unload station 22 in an operator work area 24. Illustratively, the robot 12 may be of the type manufactured by Mitsubishi, Model No. RV-E2.

A pneumatic band conveyor 26 transports the loading fixture 20 to a pickup/dropoff station 28 near the robot 12 inside a safety enclosure 30. The robot 12 picks up the spherical head 14 from the loading fixture 20 and sequentially moves it through a series of three (3) spinning lapping fixtures 32 to produce a highly reflective finish on the spherical surface 34 (shown in FIGS. 2 and 3) of the spherical head. The spherical head 14 may be made from any suitable high strength, lightweight and rustproof material, such as cobalt chrome. Illustratively, the pneumatic band conveyor 26 may be of the type manufactured by Tolmatic, Model No. BC2 Series.

The loading fixture 20 is equipped with 2 positions: a position 21 for loading an unfinished part to be lapped in the loading fixture and a position 23 for unloading a finished part from the loading fixture when the loading fixture is at the load/unload station 22 in the operator work area 24. On the other hand, the robot 12 picks up the unfinished part from the position 21 of the loading fixture and drops off a finished part at the position 23 of the loading fixture when the loading fixture is at the pickup/dropoff station 28 near the robot. As a safety measure, the robot 12 is programmed not to start a new cycle unless an unfinished part to be lapped is in the position 21 of the loading fixture 20 and the loading fixture is at the pickup/dropoff station 28 near the robot. Also, the robot 12 will not release a finished part unless the position 23 of the loading fixture 20 is empty and the loading fixture is at the pickup/dropoff station 28 near the robot.

The lapping fixtures 32 are each provided with a generally semi-spherical cavitv 74 (shown in FIGS. 2–4) and are rotatably mounted about their respective rotational axes 38. The semi-spherical cavities 74 are lined with polishing cloths 40, which are provided with adhesive backing to ensure a good contact between the polishing cloths and the semi-spherical cavities 74. The polishing cloths 40 are sprayed with a wetting agent and lapping compounds, varying from a relatively coarse grit (e.g., 3 microns) for the first lapping fixture to a transition mixture of a relatively coarse grit (e.g., 3 microns) and a relatively fine grit (e.g., 0.25 microns) for the second lapping fixture to a relatively fine grit (e.g., 0.25 microns) for the third lapping fixture. A series of three (3) spray guns 42 are mounted on a motor driven band cylinder 44. The first gun sprays the wetting agent. The second gun sprays a relatively coarse grit lapping compound. The third gun sprays a relatively fine grit lapping compound. The band cylinder 44 is programmed to move the respective one of the spray guns 42 to an appropriate one of the lapping fixtures 32 for the application of a wetting agent and a lapping compound. For the very first time for each batch of parts, each lapping fixture 32 receives application of both the wetting agent and the lapping compound. After the very first application of both the wetting agent and the lapping compound, each lapping fixture 32 receives alternate applications of the wetting agent and the lapping compound between successive cycles. The amount of lapping compound applied in each application is controlled by the nozzle diameters of the spray guns, the application time programmed for each application and the air line pressure.

Illustratively, the motor driven band cylinder 44 may be of the type manufactured by Tolmatic, Model No. BCES 100. The wetting agent may be a water based lubricating fluid—such as, Lapmaster Kemet Type W. The lapping compounds may be diamond suspensions—such as, Metadi Supreme Polycrystalline Diamond Suspensions, 3.0 micron size for the first lapping fixture (coarse grit) and 0.25 micron size for the third lapping fixtures (fine grit). The second or transition lapping fixture receives a mixture of the coarse grit and fine grit diamond suspensions. The spray application time is about 0.1 seconds. About 8 ounces each of 3.0 micron and 0.25 micron mixtures of the diamond suspensions and wetting agent are needed for processing 400 parts.

Figures 3, 4, 6:
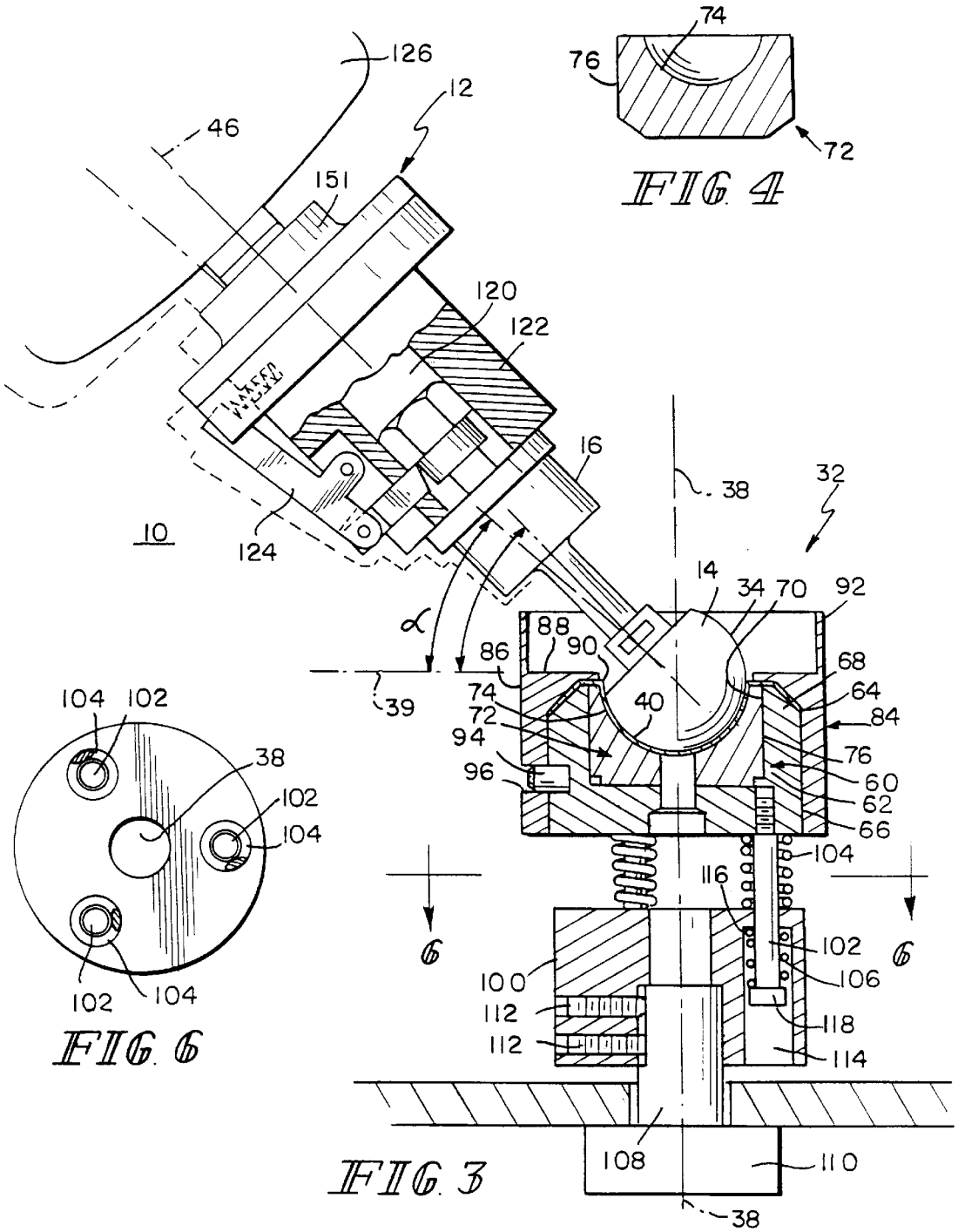
FIG. 3 is a cross-sectional view of the lapping fixture mounted on the support spindle and a portion of the robot carrying the spherical head.
FIG. 4 is a cross-sectional view of the modular insert.
FIG. 6 is a top view of the support spindle rotatably mounted about a rotational axis.

As shown in FIG. 3, the tilt angle $\alpha$ between the longitudinal axis 46 of the spherical head 14 and a line 39 perpendicular to the rotational axes 38 of the lapping fixtures 32 is varied from about 41° to about 45° between the forward and reverse rotations of the robot wrist joint 151 to obtain full coverage of the spherical surface 34. Thus, the spherical head angle $\alpha$ changes from about 41° to about 45° during clockwise or forward rotation of the spherical head 14 through about 270°. The spherical head angle $\alpha$ then changes back 41° during anticlockwise or reverse rotation of the spherical head 14 again through about 270°. Each paired rotation cycle of forward and reverse rotations of the spherical head 14 takes about 0.05 minutes. The number of paired cycles of forward and reverse rotations of the sperical head 14 for the first lapping fixture 32 vary between about 3 sets of 19 paired rotation cycles for 36 mm diameter sperical head to about 3 sets of 16 paired rotation cycles for a 22 mm diameter sperical head. The number of paired cycles of forward and reverse rotations of the sperical head 14 for the second lapping fixture 32 is about 2 sets of 14 paired rotation cycles. The number of paired cycles of forward and reverse rotations of the sperical head 14 for the third lapping fixture 32 is about 2 sets of 13 paired rotation cycles. For the very first time for each batch of parts, each lapping fixture 32 receives application of both the wetting agent and the lapping compound. (In the particular embodiment described, each batch comprises 40 spherical heads.) After the very first application of both the wetting agent and the lapping compound, each lapping fixture 32 receives alternate applications of the wetting agent and the lapping compound between successive sets of paired rotation cycles. The lapping fixtures 32 are continuously rotating at one of the three (3) preset speeds of 500, 600 and 700 rpm, depending on the diameter of the spherical head 14. Illustratively, the rotational speeds are 500 rpm, 600 rpm and 700 rpm for spherical heads having diameters of 36 and 32 mm, 28 and 26 mm and 22 mm, respectively.

The lapping apparatus 10 further includes a rinsing/air drying station 48. The spherical head 14 is rinsed and cooled with one micron-filtered RO (Reverse Osmosis) water after each lapping cycle. This step rids the spherical head 14 of the lapping compounds to minimize cross contamination. An air jet blows off excess moisture from the spherical head 14 before the robot 12 either moves the spherical head to the next lapping fixture 32 or to the pickup/dropoff station 28 to release it in the loading fixture 20.

Figure 9:
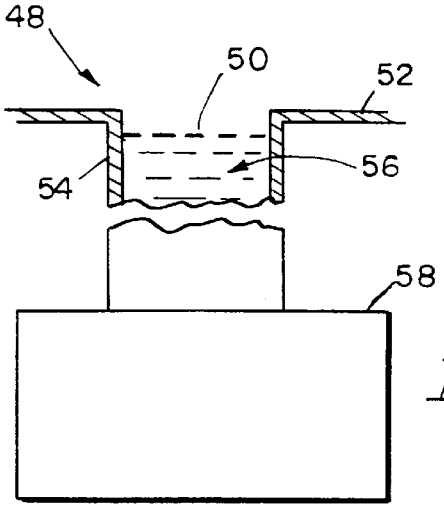

As diagrammatically shown in FIG. 9, the rinsing/air drying station 48 comprises a round opening 50 in the floor 52 that supports the pneumatic band conveyor 26 and the motor driven band cylinder 44. A six (6) inch pipe 54 is placed flush to the bottom edge of the Lexan floor 52, and four (4) rows of nozzles 56 are mounted along the inside of the pipe in a circular configuration between the opening 50 in the floor 52 and an effluent tank 58 that is used for collecting the discharge. The three (3) lowermost rows of nozzles 56 are connected to filtered RO water, and are used to rinse and cool the spherical heads 14. The uppermost row of nozzles 56 is connected to an air line, and is used to air dry the spherical heads 14. The rinsing and air drying procedure is repeated after polishing in each lapping fixture (i.e., 3 times per part). Illustratively, in this particular embodiment, the floor 52 is a Lexan sheet, the 6" pipe is a PVC pipe and the nozzles 56 are Loc-Line Circle Flow Nozzles.

As illustrated in FIG. 3, each lapping fixture 32 includes a central core 60 having a side wall 62 with a top end 64 and an opposite bottom end 66. The top end 64 includes a tapered mouth portion 68 that defines a cavity 70 for selectively receiving an interchangeable modular insert 72. As shown in FIG. 4, the modular insert 72 has an outer wall 76 that engages the inner surface of the side wall 62 of the central core 60 to provide a tight fit.

A plurality of modular inserts 72 having the same predetermined outside diameter, but different diameter semi-spherical cavities, may be provided for lapping a corresponding plurality of spherical heads having different diameters. The same predetermined outside diameter of the modular inserts 72 allows their secure reception in the cavity 70 in the central core 60 regardless of the diameters of the semi-spherical cavities therein. Thus, the same set-up can be used to produce different diameter spherical heads by simply changing the modular insert.

Figure 5:
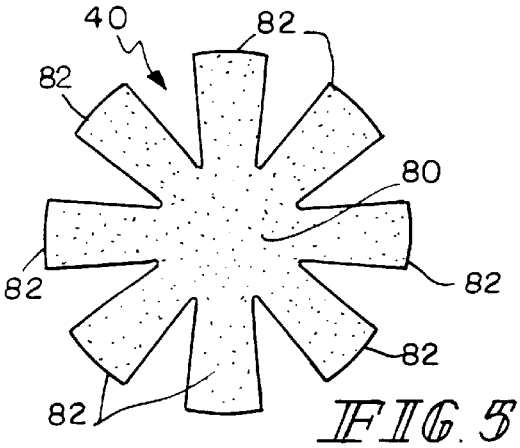
FIG. 5 is a top view of the polishing cloth prior to its installation in the modular insert.
Figure 7:
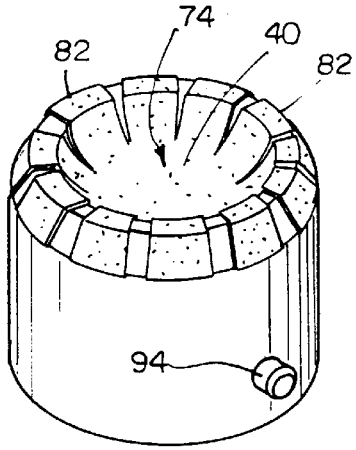
FIG. 7 is a perspective view of the central core/modular insert/polishing cloth assembly.

As shown in FIG. 5, the polishing cloths 40 are generally daisy-shaped and include a center portion 80 and a plurality of arms 82 radially extending from the center portion. As can be seen from FIG. 3, the polishing cloths 40 are positioned in each of the modular inserts 72 such that the radially extending arms 82 thereof drape over the tapered mouth portions 68 of the central cores 60.

The daisy-shaped polishing cloths 40 vary in size to accommodate different size modular inserts 72. They are changed after processing about forty (40) spherical heads. After changing the polishing cloths 40, the operator must push a reset button to restart the count-down and to indicate that the polishing cloths have been changed in order to continue the robot operation.

Figure 2:
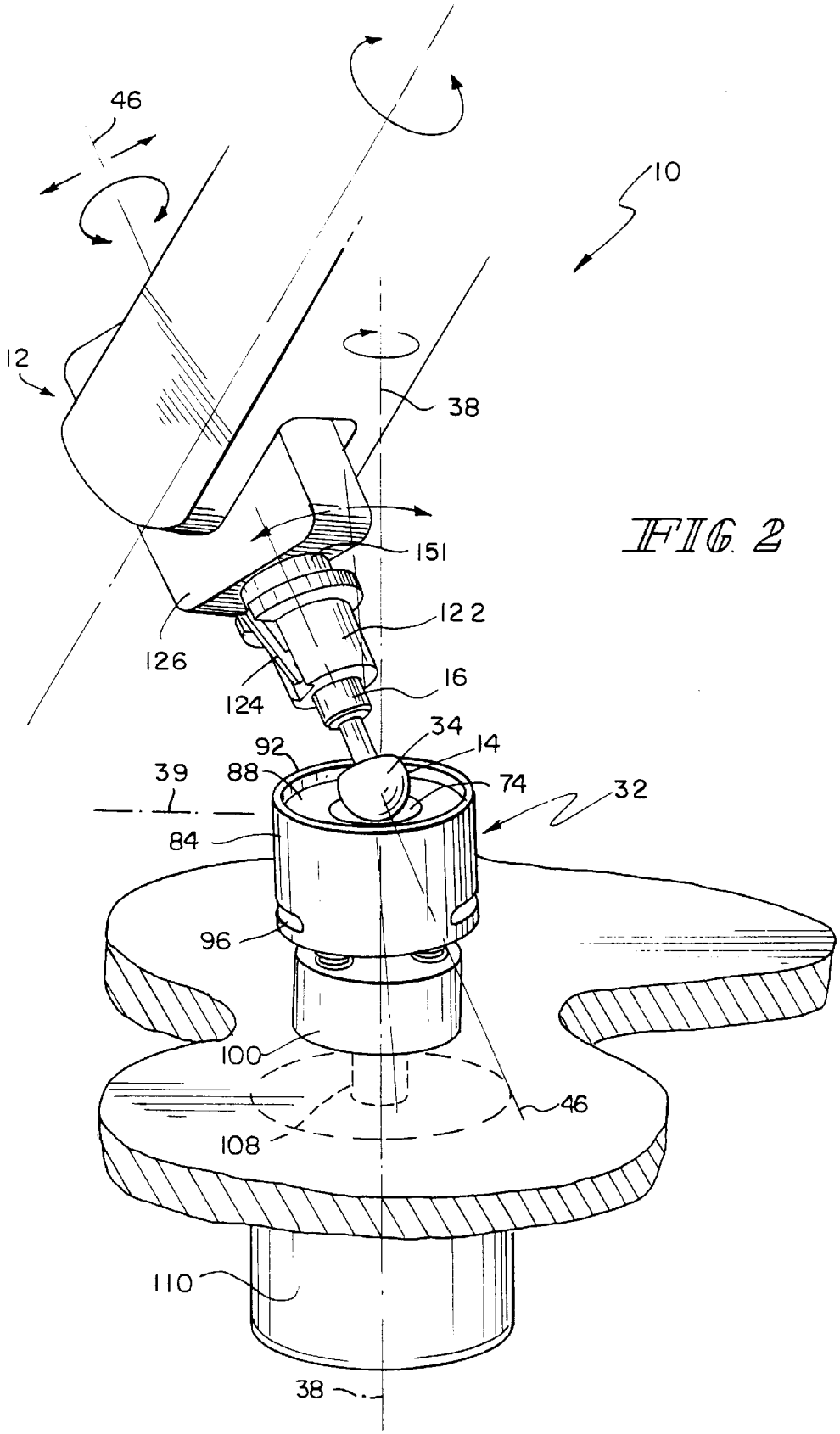
FIG. 2 is a perspective view of a portion of the FIG. 1 lapping apparatus including a robot for positioning a spherical head into a lapping fixture mounted on a support spindle, the lapping fixture comprising a central core, a modular insert received in the central core, a polishing cloth with adhesive backing inserted into a generally semi-spherical cavity in the modular insert and a hollow outer sleeve mounted over the central core to clamp the polishing cloth in place.

As shown in FIGS. 2 and 3, a hollow outer sleeve 84 is mounted over each central core 60 to hold the respective polishing cloth 40 in place. The top end 86 of each outer sleeve 84 defines an annular ledge portion 88 forming an opening 90 providing access to the generally semi-spherical cavity 74 in the modular insert 72. In addition, the top end 86 of each outer sleeve 84 forms a splash guard 92 to prevent splashing of the lapping mixture during the lapping process and during compound application. The annular ledge portion 88 extends over the tapered mouth portion 68 of the central core 60 and the top wall of the modular insert 72. When the outer sleeve 84 is mounted over the central core/modular insert/polishing cloth assembly, a lug 94 secured to the central core 60 is received in a cam-shaped slot 96 in the outer sleeve 84. The outer sleeve 84 is rotated relative to the central core 60 to draw the two together to clamp the modular insert 72 in place and to clamp the outwardly extending arms 82 of the polishing cloth 40 between the underside of the ledge portion 88 and the topside of the central core 60.

As shown in FIG. 3, each lapping fixture 32 is rotatably and compliantly mounted to a support spindle 100 for rotation therewith by means of a set of 3 equally spaced shoulder bolts 102 and a pair of opposing springs 104 and 106 in the manner depicted. The support spindle 100 is, in turn, secured to a shaft 108 of a drive motor 110 by a pair of set screws 112. FIG. 6 is a top view of the support spindle 100 and the three shoulder bolts 102 spaced 120° apart. Illustratively, the drive motor 110 may be of the type manufactured by Reliance Electric, Model No. VM-3558-2PH-1725.

As can be seen from FIG. 3, one end of each of the shoulder bolts 102 is screwed to the central core 60 and its head end is received in a slot 114 in the support spindle 100. One spring 104 is disposed between the underside of the central core 60 and the topside of the support spindle 100. The other spring 106 is disposed in the slot 114 between a wall 116 of the support spindle 100 and the head 118 of the shoulder bolt 102. The ability of the compliantly-mounted lapping fixture 32 to move side-to-side and up-and-down causes the lapping fixture to return to the same place and to remain in alignment. The compliant mounting also compensates for allowable part tolerances and produces uniform and consistent pressure between the spherical head 14 and the lapping fixture 32 during the lapping process.

As shown in FIGS. 2 and 3, the arbor 16 carrying the spherical head 14 is inserted in a slot 120 of a chuck 122 and held in place by a spring-loaded latch 124. The chuck 122 is mounted on the arm 126 of the robot 12.

Figure 8:
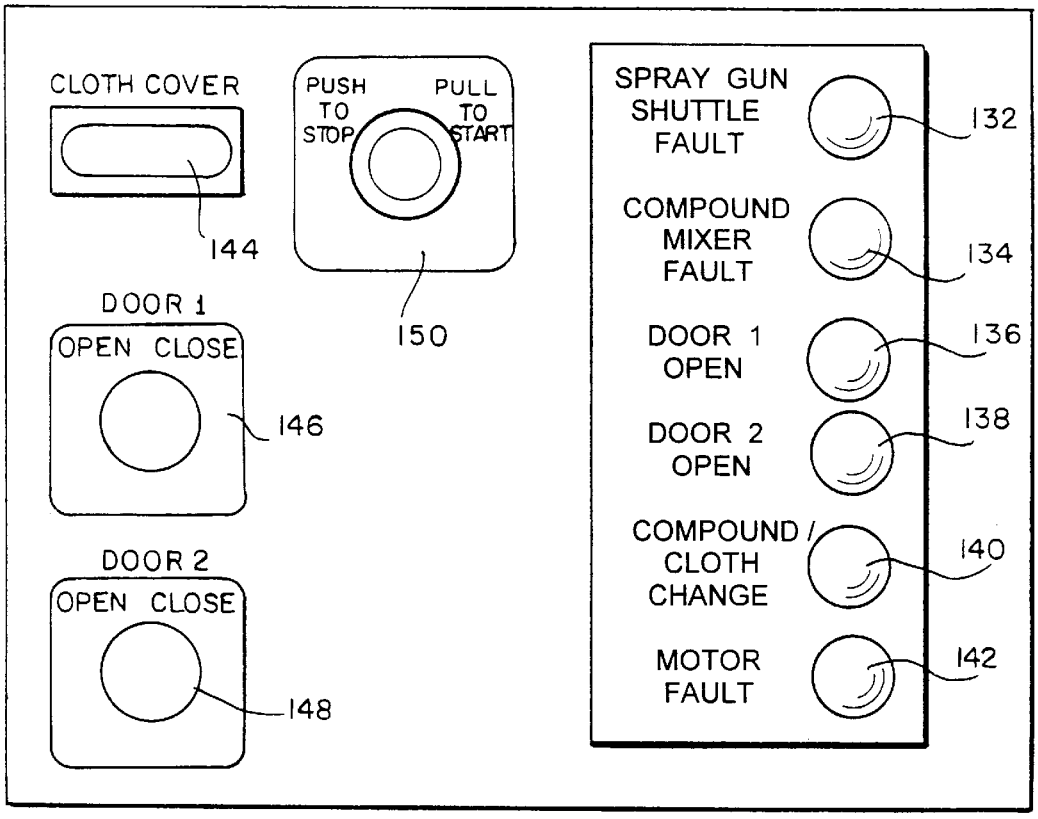
FIG. 8 shows an operator control panel of the lapping apparatus, and FIG. 9 diagrammatically shows the rinsing/air drying station for rinsing, cooling and air drying the spherical heads.

FIG. 8 shows the operator control panel 130 of the lapping apparatus 10. On the right hand side of the control panel 120 are a plurality of warning lights 132–142 to warn the operator of various fault conditions—(a) spray gun shuttle 44 fault, (b) lapping compound mixer fault, (c) the door 1 in the safety enclosure 30 providing access to the lapping fixtures 32 for changing the polishing cloths 40 open, (d) the door 2 in the safety enclosure 30 providing access to the compound tanks and the pump filter open, (e) needs compound or polishing cloth change and (f) lapping fixture drive motor 110 fault. The compound mixer keeps the lapping compound mixed and prevents settling of the diamond suspensions. On the left side of the control panel 130 are a cloth counter 144 and the switches 146 and 148 for the doors 1 and 2 in the safety enclosure 30. The numeral 150 designates the power on/off button. The robot 12 checks the machine components for faults and will automatically shut down if it identifies a fault condition.

In operation, a spherical head 14 to be lapped is mounted on the arbor 16, placed in a loading fixture 20 at the load/unload station 22 and shuttled to the pickup/dropoff station 28 near the robot 12. The robotic arm 126 is manipulated to move the spherical head 14 through the three spinning lapping fixtures 32. A coarse grit diamond suspension (e.g., 3 microns) is used in the first lapping fixture. The second lapping fixture receives a transition mixture of a relatively coarse grit (e.g., 3 microns) and a relatively fine grit (0.25 microns) diamond suspensions. The third lapping fixture receives a relatively fine grit diamond suspension (0.25 microns) to produce a fine surface finish and minimize surface irregularities. For the very first time for each batch of parts, each lapping fixture receives application of both the wetting agent and the lapping compound. After the very first application of both the wetting agent and the lapping compound, each lapping fixture receives alternate applications of the wetting agent and the lapping compound between successive sets of rotation cycles. The angle between the spherical head 14 and the lapping fixture 32 is varied between fonvard and reverse rotations of the robot wrist joint 151 to enable full coverage of the spherical surface 34. The rinsing/air drying station 48 cools the spherical head 14, rinses the diamond suspensions from the spherical head and blows off the excess moisture after polishing in each lapping fixture. The part is then either returned to the next lapping fixture 32 or released in the loading fixture 20 and transported to the load/unload station 22. The compliant support eliminates the need for exact spherical head-to-lapping fixture alignment and produces uniform and consistent pressure therebetween.

A typical cycle for lapping a spherical head is as follows: (1) check for faults, (2) pick up an unfinished spherical head, (3) move the spherical head to the first lapping fixture, (4) spray a coarse grit lapping compound and/or a wetting agent in the first lapping fixture (Note: For the very first part, both the coarse grit lapping compound and the wetting agent are sprayed. For the next 39 parts, the coparse grit lapping compound and the wetting agent are alternately sprayed.), (5) engagement of the spherical head with the first lapping fixture while it is spinning and while the angle between the longitudinal axis of the spherical head and the rotational axis of the lapping fixture is varied between the forward and reverse rotations of the spherical head, (6) lift the spherical head and spray the coarse grit lapping compound in the first lapping fixture, (7) engagement of the spherical head with the first lapping fixture while it is spinning and while the angle between the longitudinal axis of the spherical head and the rotational axis of the lapping fixture is varied between the forward and reverse rotations of the spherical head, (8) lift the spherical head and spray the wetting agent in the first lapping fixture, (9) engagement of the spherical head with the first lapping fixture while it is spinning and while the angle between the longitudinal axis of the spherical head and the rotational axis of the lapping fixture is varied between the forward and reverse rotations of the spherical head, (10) rinse, cool and air dry the spherical head, (11) move the spherical head to the second lapping fixture, (12) spray an intermediate grit lapping compound (or a mixture of coarse grit and fine grit lapping compounds) and/or the wetting agent in the second lapping fixture (Note: For the very first part, both the lapping compound and the wetting agent are sprayed. For the next 39 parts, the lapping compound and the wetting agent are alternately sprayed.), (13) engagement of the spherical head with the second lapping fixture while it is spinning and while the angle between the longitudinal axis of the spherical head and the rotational axis of the lapping fixture is varied between the forward and reverse rotations of the spherical head, (14) lift the spherical head and spray the wetting agent in the second lapping fixture, (15) engagement of the spherical head with the second lapping fixture while it is spinning and while the angle between the longitudinal axis of the spherical head and the rotational axis of the lapping fixture is varied between the forward and reverse rotations of the spherical head, (16) rinse, cool and air dry the spherical head, (17) move the spherical head to the third lapping fixture, (18) spray a fine grit lapping compound and/or the wetting agent in the third lapping fixture (Note: For the very first part, both the fine grit lapping compound and the wetting agent are sprayed. For the next 39 parts, the fine grit lapping compound and the wetting agent are alternately sprayed.), (19) engagement of the spherical head with the third lapping fixture while it is spinning and while the angle between the longitudinal axis of the spherical head and the rotational axis of the lapping fixture is varied between the forward and reverse rotations of the spherical head, (20) lift the spherical head and spray the wetting agent in the third lapping fixture, (21) engagement of the spherical head with the third lapping fixture while it is spinning and while the angle between the longitudinal axis of the spherical head and the rotational axis of the lapping fixture is varied between the forward and reverse rotations of the spherical head, (22) rinse, cool and air dry the spherical head, (23) move the spherical head to the load/unload station near the operator and unload spherical head.

Although the present invention has been described in detail with reference to certain preferred embodiments, variations and modifications exist within the scope and spirit of the present invention as described and as defined in the following claims.

What is claimed is:

1. A method of lapping a spherical head having a spherical surface disposed about a longitudinal axis, the method comprising the steps of:

rotatably mounting a lapping fixture having a top end defining a generally semi-spherical cavity about a rotational axis, securing a polishing liner in the generally semi-spherical cavity in the lapping fixture, manipulating an arm of a robot to bring a spherical head into engagement with the lapping fixture while the lapping fixture is spinning about the rotational axis, and manipulating the robotic arm to vary an angle between the longitudinal axis of the spherical head and the rotational axis of the lapping fixture during rotation of the spherical head about its longitudinal axis.

2. The method of claim 1, wherein the step of manipulating the robotic arm to vary the angle between the longitudinal axis of the spherical head and the rotational axis of the lapping fixture during rotation of the spherical head about its longitudinal axis comprises the step of manipulating the robotic arm to vary the angle between the longitudinal axis of the spherical head and the rotational axis of the lapping fixture between forward and reverse rotations of the spherical head about its longitudinal axis through less than a complete revolution.

3. The method of claim 1, further including the steps of mounting a loading fixture for motion between a load/unload station away from the robot and a pickup/dropoff station near the robot, placing a spherical head in the loading fixture at the load/unload station, transporting the loading fixture supporting the spherical head to the pickup/dropoff station near the robot and manipulating the robotic arm to pick up the spherical head from the loading fixture prior to the step of manipulating the robotic arm to bring a spherical head into engagement with the lapping fixture.

4. The method of claim 3, further including the step of manipulating the robotic arm to move the spherical head away from the lapping fixture following the step of manipulating the robotic arm to vary the angle between the longitudinal axis of the spherical head and the rotational axis of the lapping fixture during rotation of the spherical head about its longitudinal axis.

5. The method of claim 4, further including the step of manipulating the robotic arm to either move the spherical head to the next lapping fixture or move the spherical head to the pickup/drop-off station following the step of manipulating the robotic arm to move the spherical head away from the lapping fixture.

6. The method of claim 5, further including the step of manipulating the robotic arm to release the spherical head into the loading fixture at the pickup/drop-off station following the step of manipulating the robotic arm to move the spherical head to the pickup/drop-off station.

7. The method of claim 5, further including the step of moving the loading fixture supporting the spherical head to the load/unload station following the step of manipulating the robotic arm to release the spherical head into the loading fixture at the pickup/drop-off station.

8. The method of claim 7, farther including the step of removing the spherical head from the loading fixture following the step of moving the loading fixture supporting the spherical head to the load/unload station.

9. The method of claim 1, further including the step of forming a lapping fixture comprising a central core having a top end defining the generally semi-spherical cavity and an outer sleeve having an opening adapted for receiving the central core.

10. The method of claim 9, wherein the step of securing a polishing liner in the generally semi-spherical cavity in the lapping fixture comprises the steps of:

a. positioning the polishing liner in the generally semi-spherical cavity with the peripheral portion thereof extending over the top end of the central core, b. mounting the outer sleeve over the central core to clamp the peripheral portion of the polishing liner in place while exposing the generally semi-spherical cavity through the opening therein.

11. The method of claim 10, further including the step of forming a polishing liner comprising a generally daisy-shaped polishing cloth having a center portion and a plurality of peripheral arms extending away from the center portion.

12. The method of claim 11, further including the step of providing the generally daisy-shaped polishing cloth with an adhesive backing to ensure a good contact between the mating surfaces of the polishing cloth and the semi-spherical cavity.

13. The method of claim 10, further including the step of applying a lapping compound to the polishing liner prior to the step of manipulating the robotic arm to bring the spherical head into engagement with the lapping fixture while the lapping fixture is spinning about the rotational axis.

14. The method of claim 13, wherein the step of applying a lapping compound to the polishing liner comprises the step of spraying the polishing liner with a wetting agent and diamond suspensions.

15. The method of claim 13, wherein the step of applying a lapping compound to the polishing liner comprises the steps of:

a. providing a spray gun, b. periodically moving the spray gun to the lapping fixture, and c. operating the spray gun to spray the lapping compound on the polishing liner.

16. The method of claim 10, wherein the step of forming a lapping fixture comprising a central core having a top end defining a generally semi-spherical cavity comprises the steps of:

a. providing the top end with a cavity in the top wall thereof, b. forming a modular insert having a generally semi-spherical cavity and dimensioned for secure reception in the cavity in the top end of the central core, and c. positioning the modular insert in the cavity in the top end of the central core.

17. The method of claim 16, wherein the step of forming a modular insert comprises the step of forming a plurality of inserts for lapping a corresponding plurality of spherical heads having different diameters, each insert having the same predetermined outside diameter for secure reception in the in the cavity in the central core of the lapping fixture and having a different diameter semi-spherical cavity.

18. The method of claim 13, further including the steps of manipulating the robotic arm to move the spherical head away from the lapping fixture, rinsing the lapping compound from the spherical head, air drying the spherical head, and manipulating the robotic arm to either move the rinsed and air dried spherical head to the next lapping fixture or move the rinsed and air dried spherical head to the pickup/drop-off station and to release the spherical head into the loading fixture at the pickup/drop-off station.

19. The method of claim 18, wherein the step of rinsing the lapping compound from the spherical head and air drying the spherical head comprises the steps of:

a. providing a plurality of rows of spray nozzles arranged in a circular configuration, b. connecting the first ones of the rows of the spray nozzles to a supply of fluid, c. connecting the last ones of the rows of spray nozzles to a supply of air, d. manipulating the robotic arm to move the spherical head to the spray nozzles, and e. operating the spray nozzles to rinse the lapping compound from the spherical head and to air dry the spherical head.

20. The method of claim 1, wherein the step of connecting the first ones of the rows of the spray nozzles to a supply of fluid comprises the step of connecting the first ones of the rows of the spray nozzles to a supply of filtered RO water.

21. The method of claim 1, wherein the step of rotatably mounting a lapping fixture comprises the steps of:

a. rotatably mounting a support spindle about a rotational axis, b. providing a motor for selectively causing rotation of the support spindle, c. providing at least one connector having its respective ends connected to the lapping fixture and the support spindle in a manner allowing limited axial movement therebetween while transmitting rotation of the support spindle to the lapping fixture, d. resiliently biasing the lapping fixture with respect to the support spindle.

22. The method of claim 20, wherein the step of resiliently biasing the lapping fixture with respect to the support spindle consists of the step of providing a pair of opposing springs disposed about the connector.

23. A method of lapping a spherical head having a spherical surface disposed about a longitudinal axis, the method comprising the steps of:

forming a central core having a top end defining a generally semi-spherical cavity, rotatably mounting the central core about a rotational axis, forming a polishing liner having a center portion and a peripheral portion, positioning the polishing liner in the generally semi-spherical cavity with the peripheral portion thereof extending over the top end of the central core, forming, an outer sleeve having an opening therein, mounting the outer sleeve over the central core to clamp the peripheral portion of the polishing liner in place while exposing the generally semi-spherical cavity through the opening, therein, manipulating a robotic arm to bring a spherical head into engagement with the polishing liner disposed in the generally semi-spherical cavity in the central core while it is spinning about the rotational axis, and manipulating the robotic arm to vary an angle between the longitudinal axis of the spherical head and the rotational axis of the central core during rotation of the spherical head about its longitudinal axis.

24. The method of claim 23, wherein the step of manipulating the robotic arm to vary the angle between the longitudinal axis of the spherical head and the rotational axis of the lapping fixture during rotation of the spherical head about its longitudinal axis comprises the step of manipulating the robotic arm to vary the angle between the longitudinal axis of the spherical head and the rotational axis of the lapping fixture between forward and reverse rotations of the spherical head about its longitudinal axis through less than a complete revolution.

25. The method of claim 23, wherein the step of forming a central core having a top end defining a generally semi-spherical cavity comprises the steps of:

a. providing the top end with a cavity in the top wall thereof, b. forming a modular insert having a generally semi-spherical cavity and dimensioned for secure reception in the cavity in the top end of the central core, and c. positioning the modular insert in the cavity in the top end of the central core.

26. The method of claim 25, wherein the step of forming a modular insert comprises the step of forming a plurality of inserts for lapping a corresponding plurality of spherical heads having different diameters, each insert having the same predetermined outside dimension for secure reception in the in the cavity in the central core of the lapping fixture and having a different diameter semi-spherical cavity.

27. The method of claim 23, wherein the step of forming a polishing liner consists of the step of forming a generally daisy-shaped polishing cloth having a center portion and a peripheral portion comprising a plurality of arms extending away from the center portion.

28. The method of claim 27, further including the step of providing the generally daisy-shaped polishing cloth with an adhesive backing following the step of forming a generally daisy-shaped polishing cloth to ensure good engagement between the mating surfaces of the polishing cloth and the semi-spherical cavity.

29. The method of claim 28, further including the step of applying a lapping compound to the polishing cloth prior to the step of manipulating the robotic arm to bring the spherical head into engagement with the polishing cloth disposed in the generally semi-spherical cavity.

30. The method of claim 29, wherein the step of applying a lapping compound to the polishing cloth comprises the step of spraying the polishing liner with a wetting agent and diamond suspensions.

31. The method of claim 30, wherein the step of spraying the polishing liner with a wetting agent and diamond suspensions comprises the steps of:

a. providing a spray gun, b. periodically moving the spray gun to a position near the central core, and c. operating the spray gun to spray the wetting agent and diamond suspensions on the polishing liner.

32. The method of claim 29, further including the steps of manipulating the robotic arm to move the spherical head away from the central core, rinsing the lapping compound from the spherical head, air drying the spherical head and manipulating the robotic arm to either move the rinsed and air dried spherical head to the next lapping fixture or move the rinsed and air dried spherical head to a pickup/drop-off station and release the spherical head into a loading fixture at the pickup/drop-off station.

33. The method of claim 32, wherein the step of rinsing the lapping compound from the spherical head and air drying the spherical head comprises the steps of:

a. providing a plurality of rows of spray nozzles arranged in a circular configuration, b. connecting the first ones of the rows of the spray nozzles to a supply of fluid, c. connecting the last ones of the rows of spray nozzles to a supply of air, d. manipulating the robotic arm to move the spherical head to the spray nozzles, and e. operating the spray nozzles to rinse the lapping compound from the spherical head and to air dry the spherical head.

34. The method of claim 23, further including the steps of placing a spherical head in a loading fixture at a load/unload station, transporting the loading fixture supporting the spherical head to a pickup/dropoff station near the robot and manipulating the robotic arm to pick up the spherical head from the loading fixture prior to the step of manipulating the robotic arm to bring a spherical head into engagement with the polishing liner.

35. The method of claim 34, further including the step of manipulating the robotic arm to move the spherical head away from the central core following the step of manipulating the robotic arm to vary the angle between the longitudinal axis of the spherical head and the rotational axis of the central core during rotation of the spherical head about its longitudinal axis.

36. The method of claim 35, further including the step of manipulating the robotic arm to either move the spherical head to the next lapping station or move the spherical head to the pickup/drop-off station following the step of manipulating the robotic arm to move the spherical head away from the central core.

37. The method of claim 36, further including the step of manipulating the robotic arm to release the spherical head into a loading fixture at the pickup/drop-off station following the step of manipulating the robotic arm to move the spherical head to the pick-up/drop-off station.

38. The method of claim 37, further including the step of moving the loading fixture supporting the spherical head to the load/unload station following the step of manipulating the robotic arm to release the spherical head into a loading fixture at the pickup/drop-off station.

39. The method of claim 38, further including the step of removing the spherical head from the loading fixture following the step of moving the loading fixture supporting the spherical head to the load/unload station.

40. A method of lapping a spherical head having a spherical surface disposed about a longitudinal axis, the method comprising the steps of:

rotatably mounting a lapping fixture having a top end defining a generally semi-spherical cavity about a rotational axis, securing a polishing liner in the generally semi-spherical cavity in the lapping fixture, applying a lapping compound to the polishing liner, manipulating a robotic arm to bring the spherical head into engagement with the polishing liner disposed in the generally semi-spherical cavity in the lapping fixture while it is spinning about the rotational axis, manipulating the robotic arm to vary an angle between the longitudinal axis of the spherical head and the rotational axis of the lapping fixture during rotation of the spherical head about its longitudinal axis, and rinsing the lapping compound from the spherical head.

41. The method of claim 40, wherein the step of manipulating the robotic arm to vary the angle between the longitudinal axis of the spherical head and the rotational axis of the lapping fixture during rotation of the spherical head about its longitudinal axis comprises the step of manipulating the robotic arm to vary the angle between the longitudinal axis of the spherical head and the rotational axis of the lapping fixture between forward and reverse rotations of the spherical head about its longitudinal axis through less than a complete revolution.

42. The method of claim 40, further including the step of forming a lapping fixture comprising a central core having a top end defining the generally semi-spherical cavity and an outer sleeve having an opening adapted for receiving the central core.

43. The method of claim 42, wherein the step of securing a polishing liner in the generally semi-spherical cavity in the lapping fixture comprises the steps of:

a. positioning the polishing liner in the generally semi-spherical cavity with the peripheral portion thereof extending over the top end of the central core, b. mounting the outer sleeve over the central core to clamp the peripheral portion of the polishing liner in place while exposing the generally semi-spherical cavity through the opening therein.

44. The method of claim 40, farther including the step of forming a polishing liner comprising a generally daisy-shaped polishing cloth having a center portion and a plurality of peripheral arms extending away from the center portion.

45. The method of claim 44, further including the step of providing the generally daisy-shaped polishing cloth with an adhesive backing to ensure good engagement between the mating sur faces of the polishing cloth and the semi-spherical cavity.

46. The method of claim 40, wherein the step of applying a lapping compound to the polishing liner comprises the step of spraying the polishing liner with a wetting agent and diamond suspensions.

47. The method of claim 40, wherein the step of applying a lapping compound to the polishing liner comprises the steps of:

a. providing a spray gun, b. periodically moving the spray gun to the lapping fixture, and c. operating the spray gun to spray the lapping compound on the polishing liner.

48. The method of claim 42, wherein the step of forming a lapping fixture comprising a central core having a top end defining a generally semi-spherical cavity comprises the steps of:

a. providing the top end with a cavity in the top wall thereof, b. forming a modular insert having a generally semi-spherical cavity and dimensioned for secure reception in the cavity in the top end of the central core, and c. positioning the modular insert in the cavity in the top end of the central core.

49. The method of claim 48, wherein the step of forming a modular insert comprises the step of forming a plurality of inserts for lapping a corresponding plurality of spherical heads having different diameters, each insert having the same predetermined outside dimension for secure reception in the in the cavity in the central core of the lapping fixture and having a different diameter semi-spherical cavity.

50. The method of claim 40, wherein the step of rinsing the lapping compound from the spherical head comprises the steps of:

a. providing a plurality of rows of spray nozzles arranged in a circular configuration, b. connecting the first ones of the plurality of rows of the spray nozzles to a supply of fluid, c. connecting the last ones of the plurality of rows of the spray nozzles to air, d. manipulating the robotic arm to move the spherical head to the spray nozzles, and e. operating the spray nozzles to rinse the lapping compound from the spherical head and to air dry the spherical head.

51. The method of claim 50, wherein the step of connecting the first ones of the plurality of rows of the spray nozzles to a supply of fluid comprises the step of connecting the first ones of the plurality of rows of the spray nozzles to a supply of filtered RO water.

52. A method of lapping a spherical head having a spherical surface disposed about a longitudinal axis, the method comprising the steps of: rotatably mounting a plurality of lapping fixtures having generally semi-spherical cavities, securing polishing liners in the generally semi-spherical cavities, applying a wetting agent and lapping compounds, varying from a relatively coarse grit to a relatively fine grit, to the polishing liners, manipulating an arm of a robot to sequentially bring the spherical head into engagement with the polishing liners disposed in the lapping fixtures while the lapping fixtures are spinning about their respective rotational axes and to vary an angle between the longitudinal axis of the spherical head and the rotational axes of the lapping fixtures during rotation of the spherical head about its rotational axis.

53. The method of claim 52, wherein the step of manipulating the robotic arm to vary the angle between the longitudinal axis of the spherical head and the rotational axis of the lapping fixture during rotation of the spherical head about its longitudinal axis comprises the step of manipulating the robotic arm to vary the angle between the longitudinal axis of the spherical head and the rotational axis of the lapping fixture between forward and reverse rotations of the spherical head about its longitudinal axis.

54. The method of claim 53, further including the steps of rinsing the lapping compound from the spherical head and air drying the spherical head comprising:

a. providing a plurality of rows of spray nozzles arranged in a circular configuration, b. connecting the first ones of the plurality of rows of the spray nozzles to a supply of fluid, c. connecting the last ones of the plurality of rows of the spray nozzles to air, d. manipulating the robotic arm to move the spherical head to the spray nozzles, and e. operating the spray nozzles to rinse the lapping compound from the spherical head and to air dry the spherical head.

55. A method of lapping a spherical head having a spherical surface disposed about a longitudinal axis, the method comprising the steps of: rotatably mounting a plurality of lapping fixtures having generally semi-spherical cavities, securing polishing liners in the generally semi-spherical cavities, sequentially bringing a spherical head into engagement with the polishing liners disposed in the lapping fixtures while the lapping fixtures are spinning about their respective rotational axes and varying an angle between the longitudinal axis of the spherical head and the rotational axes of the lapping fixtures during rotation of the spherical head about its longitudinal axis.

56. The method of claim 55, wherein the step of varying the angle between the longitudinal axis of the spherical head and the rotational axes of the lapping fixtures during rotation of the spherical head about its longitudinal axis comprises the step of varying the angle between the longitudinal axis of the spherical head and the rotational axes of the lapping fixtures between forward and reverse rotations of the spherical head about its longitudinal axis.

57. The method of claim 55, further including the step of applying a wetting agent and lapping compounds, varying from a coarse grit to a fine grit, to the lapping fixtures prior to the step of sequentially bringing the spherical head into engagement with the lapping fixtures.

58. The method of claim 57, further including the steps of rinsing the lapping compound from the spherical head and air drying the spherical head comprising:

a. providing a plurality of rows of spray nozzles arranged in a circular configuration, b. connecting the first ones of the plurality of rows of the spray nozzles to a supply of fluid, c. connecting the last ones of the plurality of rows of the spray nozzles to air, d. manipulating the robotic arm to move the spherical head to the spray nozzles, and e. operating the spray nozzles to rinse the lapping compound from the spherical head and to air dry the spherical head.

59. A method of lapping a spherical bead having a spherical surface disposed about a longitudinal axis, the method comprising the steps of:

forming a central core having a top end defining a cavity in the top wall thereof, rotatably mounting the central core about a rotational axis, forming a modular insert having a generally semi-spherical cavity and dimensioned for secure reception in the cavity in the top wall of the central core, positioning the modular insert in the cavity in the top wall of the central core, forming a polishing liner having a center portion and a peripheral portion, positioning the polishing liner in the generally semi-spherical cavity with the peripheral portion thereof overlying the top end of the central core, forming an outer sleeve having an opening therein, mounting the outer sleeve over the central core to clamp the polishing cloth in place while exposing the generally semi-spherical cavity through the opening therein, manipulating a robotic arm to pick up a spherical head, manipulating the robotic arm to bring the spherical head into engagement with the polishing liner disposed in the generally semi-spherical cavity in the modular insert while the central core/modular insert/polishing liner/outer sleeve assembly is spinning about the rotational axis, and manipulating the robotic arm to vary the angle between the longitudinal axis of the spherical head and the rotational axis of the central core during rotation of the spherical head about its longitudinal axis.

60. The method of claim 59, wherein the step of manipulating the robotic arm to vary the angle between the longitudinal axis of the spherical head and the rotational axis of the central core during rotation of the spherical head about its longitudinal axis comprises the step of manipulating the robotic arm to vary the angle between the longitudinal axis of the spherical head and the rotational axis of the central core between forward and reverse rotations of the spherical head about its longitudinal axis through less than a complete revolution.

61. The method of claim 59, wherein the step of forming a modular insert comprises the step of forming a plurality of inserts for lapping a corresponding plurality of spherical heads having different diameters, each insert having the same predetermined outside dimension for secure reception in the in the cavity in the central core of the lapping fixture and having a different diameter semi-spherical cavity.

62. The method of claim 59, wherein the step of forming a polishing liner consists of the step of forming a generally daisy-shaped polishing cloth having a center portion and a peripheral portion comprising a plurality of arms extending away from the center portion.

63. The method of claim 62, further including the step of providing the generally daisy-shaped polishing cloth with an adhesive backing following the step of forming a generally daisy-shaped polishing cloth to ensure good engagement between the polishing cloth and the semi-spherical cavity.

64. The method of claim 63, further including the step of applying a lapping compound to the polishing cloth prior to the step of manipulating the robotic arm to bring the spherical head into engagement with the polishing cloth disposed in the generally semi-spherical cavity.

65. The method of claim 64, wherein the step of applying a lapping compound to the polishing cloth comprises the step of spraying the polishing liner with a wetting agent and diamond suspensions.

66. The method of claim 65, wherein the step of spraying the polishing liner with a wetting agent and diamond suspensions comprises the steps of:

a. providing a spray gun, b. periodically moving the spray gun to a position near the central core, and c. operating the spray gun to spray the wetting agent and diamond suspensions on the polishing liner.

67. The method of claim 64, further including the steps of manipulating the robotic arm to move the spherical head away from the central core, rinsing the lapping compound from the spherical head, air drying the spherical head and manipulating the robotic arm to either move the rinsed and air dried spherical head to the next central core/modular insert/polishing liner/outer sleeve assembly or move the rinsed and air dried spherical head to a pickup/drop-off station and release the spherical head into a loading fixture at the pickup/drop-off station.

68. The method of claim 67, wherein the step of rinsing the lapping compound from the spherical head and air drying the spherical head comprises the steps of:

a. providing a plurality of rows of spray nozzles arranged in a circular configuration, b. connecting the first ones of the plurality of rows of the spray nozzles to a supply of fluid, c. connecting the last ones of the plurality of rows of the spray nozzles to air, d. manipulating the robotic arm to move the spherical head to the spray nozzles, and e. operating the spray nozzles to rinse the lapping compound from the spherical head and to air dry the spherical head.

69. The method of claim 59, wherein the step of manipulating the arm of a robot to pick up a spherical head comprises the steps of placing the spherical head in a loading fixture at a load/unload station, transporting the loading fixture supporting the spherical head to a pickup/dropoff station near the robot and manipulating the robotic arm to pick up the spherical head from the loading fixture.

70. The method of claim 59, further including the step of manipulating the robotic arm to move the spherical head away from the central core following the step of manipulating the robotic arm to vary the angle between the axis of the spherical head and the rotational axis of the central core during rotation of the spherical head about its longitudinal axis.

71. The method of claim 70, further including the step of manipulating the robotic arm to either move the spherical head to the next central core/modular insert/polishing liner/outer sleeve assembly or move the spherical head to a pickup/drop-off station following the step of manipulating the robotic arm to move the spherical head away from the central core.

72. The method of claim 71, further including the step of manipulating the robotic arm to release the spherical head into the loading fixture at the pickup/drop-off station following the step of manipulating the robotic arm to move the spherical head to the pickup/drop-off station.

73. The method of claim 72, further including the step of moving the loading fixture supporting the spherical head to the load/unload station following the step of manipulating the robotic arm to release the spherical head into a loading fixture at the pickup/drop-off station.

74.The method of claim 73, further including the step of removing the spherical head from the loading fixture following the step of moving the loading fixture supporting the spherical head to the load/unload station.

75. A method of lapping a spherical head having a spherical surface disposed about a longitudinal axis, the method comprising the steps of:

forming a central core having a top end defining a cavity in the top wall thereof, rotatably mounting the central core about a rotational axis, forming a modular insert having a generally semi-spherical cavity and dimensioned for secure reception in the cavity in the top wall of the central core, positioning the modular insert in the cavity in the top wall of the central core, forming a generally daisy-shaped polishing cloth having a center portion and a peripheral portion comprising a plurality of arms extending away from the center portion, providing the generally daisy-shaped polishing cloth with an adhesive backing, positioning the polishing cloth in the generally semi-spherical cavity with the peripheral portion thereof overlying the top end of the central core, the adhesive backing ensuring good engagement between the mating surfaces of the polishing cloth and the semi-spherical cavity, forming an outer sleeve having an opening therein, mounting the outer sleeve over the central core to clamp the polishing cloth in place while exposing the generally semi-spherical cavity through the opening therein, applying a lapping compound to the polishing cloth, manipulating an arm of a robot to pick up a spherical head, manipulating the robotic arm to bring the spherical head into engagement with the polishing cloth disposed in the generally semi-spherical cavity in the modular insert while the central core/modular insert/polishing cloth/outer sleeve assembly is spinning about the rotational axis, manipulating the robotic arm to vary an angle between the longitudinal axis of the spherical head and the rotational axis of the central core during rotation of the spherical head about its longitudinal axis, moving the spherical head away from the central core, and rinsing the lapping compound from the spherical head.

76. The method of claim 75, wherein the step of manipulating the robotic arm to vary the angle between the longitudinal axis of the spherical head and the rotational axis of the central core during rotation of the spherical head about its longitudinal axis comprises the step of manipulating the robotic arm to vary the angle between the longitudinal axis of the spherical head and the rotational axis of the central core between forward and reverse rotations of the spherical head about its longitudinal axis through less than a complete revolution.

77. The method of claim 75, wherein the step of manipulating the arm of a robot to pick up a spherical head comprises the steps of placing the spherical head in a loading fixture at a load/unload station, transporting the loading fixture supporting the spherical head to a pickup/drop-off station near the robot and manipulating the robotic arm to pick up the spherical head from the loading fixture.

78. The method of claim 75, further including the step of manipulating the robotic arm to either move the spherical head to the next central core/modular insert/polishing cloth/outer sleeve assembly or move the spherical head to a pickup/drop-off station and release the spherical head into a loading fixture at the pickup/drop-off station following the step of manipulating the robotic arm to move the spherical head to the pickup/drop-off station.

79. The method of claim 78, further including the step of moving the loading fixture supporting the spherical head to the load/unload station following the step of manipulating the robotic arm to release the spherical head into a loading fixture at the pickup/drop-off station.

80. The method of claim 79, further including the step of removing the spherical head from the loading fixture following the step of moving the loading fixture supporting the spherical head to the load/unload station.

81. A method of lapping a spherical head having a spherical surface disposed about a longitudinal axis, the method comprising the steps of:

forming a central core having a top end defining a cavity in the top wall thereof, rotatably mounting a support spindle about a rotational axis, providing a motor for selectively causing rotation of the support spindle, resiliently mounting the central core on the support spindle for rotation therewith about the rotational axis, forming a modular insert having a generally semi-spherical cavity and dimensioned for secure reception in the cavity in the top wall of the central core, positioning the modular insert in the cavity in the top wall of the central core, forming a generally daisy-shaped polishing cloth having a center portion and a peripheral portion comprising a plurality of and extending away from the center portion, providing the generally daisy-shaped polishing cloth with an adhesive backing, positioning the polishing cloth in the generally semi-spherical cavity with the peripheral portion thereof overlying the top end of the central core, the adhesive backing ensuring good engagement between the polishing cloth and the semi-spherical cavity, forming an outer sleeve having an opening therein, mounting the outer sleeve over the central core to clamp the polishing cloth in place while exposing the generally semi-spherical cavity through the opening therein, spraying the polishing cloth with a wetting agent and diamond suspensions, manipulating an arm of a robot to pick up a spherical head, manipulating the robotic arm to bring the spherical head into engagement with the polishing cloth sprayed with a wetting agent and diamond suspensions and disposed in the generally semi-spherical cavity in the modular insert while the central core/modular insert/polishing cloth/outer sleeve assembly is spinning about the rotational axis, manipulating the robotic arm to vary an angle between the longitudinal axis of the spherical head and the rotational axis of the central core during rotation of the spherical head about its longitudinal axis, moving the spherical head away from the central core, and rinsing the spherical head.

82. The method of claim 81, wherein the step of manipulating the robotic arm to vary the angle between the longitudinal axis of the spherical head and the rotational axis of the central core during rotation of the spherical head about its longitudinal axis comprises the step of manipulating the robotic arm to vary the angle between the longitudinal axis of the spherical head and the rotational axis of the central core between forward and reverse rotations of the spherical head about its longitudinal axis through less than a complete revolution.

83. The method of claim 81, wherein the step of resiliently mounting the central core on the support spindle for rotation therewith comprises the steps of:

a. providing at least one connector having its respective ends connected to the central core and the support spindle in a manner allowing limited axial movement therebetween while transmitting rotation of the spindle to the central core, b. a pair of oppositely disposed springs disposed about the connector for resiliently biasing the central core with respect to the support spindle.

84. The method of claim 81, wherein the step of manipulating the arm of a robot to pick up a spherical head comprises the steps of placing the spherical head in a loading fixture at a load/unload station, transporting the loading fixture supporting the spherical head to the pickup/drop-off station near the robot and manipulating the robotic arm to pick up the spherical head from the loading fixture.

85. The method of claim 81, further including the step of manipulating the robotic arm to either move the spherical head to the next central core/modular insert/polishing cloth/outer sleeve assembly or move the spherical head to a pickup/drop-off station and release the spherical head into a loading fixture at the pickup/drop-off station following the step of rinsing the spherical head.

86. The method of claim 85, further including the step of moving the loading fixture supporting the spherical head to a load/unload station following the step of manipulating the robotic arm to release the spherical head into a loading fixture at the pickup/drop-off station.

87. The method of claim 86, further including the step of removing the spherical head from the loading fixture following the step of moving the loading fixture supporting the spherical head to the load/unload station.

88. A method of lapping a spherical head having a spherical surface disposed about a longitudinal axis, the method comprising the steps of:

rotatably mounting first, second and third lapping fixtures about their respective rotational axes, first, second and third lapping fixtures defining first, second and third generally semi-spherical cavities, securing first, second and third polishing liners in first, second and third generally semi-spherical cavities in the lapping fixtures, applying a relatively coarse grit first lapping compound and a wetting agent, an intermediate grit second lapping compound and a wetting agent and a relatively fine grit third lapping compound and a wetting agent to the first, second and third polishing liners respectively, manipulating an arm of a robot to pick up a spherical head, manipulating the robotic arm to bring the spherical head into engagement with the first polishing liner disposed in the first lapping fixture while it is spinning about its rotational axis, manipulating the robotic arm to vary an angle between the longitudinal axis of the spherical head and the rotational axis of the first lapping fixture during forward and reverse rotations of the spherical head about its longitudinal axis through less than a complete revolution, manipulating the robotic arm to move the spherical head to a rinsing/air drying station to rinse the first lapping compound from the spherical head and air dry the spherical head, manipulating the robotic aim to bring the spherical head into engagement with the second polishing liner disposed in the second lapping fixture while it is spinning about its rotational axis, manipulating the robotic arm to vary the angle between the longitudinal axis of the spherical head and the rotational axis of the second lapping fixture during forward and reverse rotations of the spherical head about its longitudinal axis through less than a complete revolution, manipulating the robotic arm to move the spherical head to a rinsing/air drying station to rinse the second lapping compound from the spherical head and air dry the spherical head, manipulating the robotic arm to bring the spherical head into engagement with the third polishing liner disposed in the third lapping fixture while it is spinning about its rotational axis, manipulating the robotic arm to vary the angle between the longitudinal axis of the spherical head and the rotational axis of the third lapping fixture during forward and reverse rotations of the spherical head about its longitudinal axis through less than a complete revolution, and manipulating the robotic arm to move the spherical head to a rinsing/air drying station to rinse the third lapping compound from the spherical head and air dry the spherical head.

89. The method of claim 88 wherein the step of manipulating the robotic arm to vary the angle between the longitudinal axis of the spherical head and the rotational axis of the first lapping fixture during forward and reverse rotations of the spherical head about its longitudinal axis through less than a complete revolution comprises the step of manipulating the robotic arm to vary the angle between the longitudinal axis of the spherical head and the rotational axis of the first lapping fixture from about 49° to about 45° during forward rotation of the spherical head about its longitudinal axis through about 270° and then to vary this angle between the longitudinal axis of the spherical head and the rotational axis of the first lapping fixture from about 45° to about 49° during reverse rotation of the spherical head about its longitudinal axis again through about 270°.

90. The method of claim 89 wherein the step of manipulating the robotic arm to vary the angle between the longitudinal axis of the spherical head and the rotational axis of the second lapping fixture during forward and reverse rotations of the spherical head about its longitudinal axis through less than a complete revolution comprises the step of manipulating the robotic arm to vary the angle between the longitudinal axis of the spherical head and the rotational axis of the second lapping fixture from about 49° to about 45° during forward rotation of the spherical head about its longitudinal axis through about 270° and then to vary this angle between the longitudinal axis of the spherical head and the rotational axis of the second lapping fixture from about 45° to about 49° during reverse rotation of the spherical head about its longitudinal axis again through about 270°.

91. The method of claim 90 wherein the step of manipulating the robotic arm to vary the angle between the longitudinal axis of the spherical head and the rotational axis of the third lapping fixture during forward and reverse rotations of the spherical head about its longitudinal axis through less than a complete revolution comprises the step of manipulating the robotic arm to vary the angle between the longitudinal axis of the spherical head and the rotational axis of the third lapping fixture from about 49° to about 45° during forward rotation of the spherical head about its longitudinal axis through about 270° and then to vary this angle between the longitudinal axis of the spherical head and the rotational axis of the third lapping fixture from about 45° to about 49° during reverse rotation of the spherical head about its longitudinal axis again through about 270°.

* * * * *